US005711725A

United States Patent [19]

Bengtson

[11] Patent Number: 5,711,725

[45] Date of Patent: Jan. 27, 1998

[54] PRACTICE BASEBALL/SOFTBALL WITH CONTRASTING COLORS

[76] Inventor: Timothy A. Bengtson, 2704 Lawrence Ave., Lawrence, Kans. 66047

[21] Appl. No.: 788,048

[22] Filed: Jan. 23, 1997

[51] Int. Cl.[6] ..... A63B 69/00

[52] U.S. Cl. ..... 473/451; 473/598

[58] Field of Search ..... 473/451, 459, 473/607, 598, 135

[56] References Cited

U.S. PATENT DOCUMENTS

| | | | |
|---|---|---|---|
| D. 263,491 | 3/1982 | Surridge . | |
| 280,807 | 7/1883 | Farley . | |
| D. 339,240 | 9/1993 | Perkins . | |
| 676,506 | 6/1901 | Knight et al. . | |
| 1,118,727 | 11/1914 | Bibeault . | |
| 1,236,290 | 8/1917 | Griffin . | |
| 1,634,146 | 6/1927 | Henry | 473/607 |
| 2,925,273 | 2/1960 | Pratt . | |
| 4,170,352 | 10/1979 | Vcala | 473/459 |
| 4,991,838 | 2/1991 | Groves . | |
| 5,284,343 | 2/1994 | Bigornia et al. . | |
| 5,607,152 | 3/1997 | Strassburger | 473/451 |

OTHER PUBLICATIONS

Playthings, Mar. 1951.

Golf Digest, Dec. 1986, p.116.

"Worth Catalogue", pp. 7,Copy available in USPTO 473/FOR135.

*Primary Examiner*—Mark S. Graham

*Attorney, Agent, or Firm*—Kokjer, Kircher, Bowman & Johnson

[57] ABSTRACT

A two colored baseball or softball for practice. One half of the outer surface is a dark color and one half is light to make the ball more difficult to see than a standard ball. When used for practice, the ball requires players to concentrate intensely in order to hit or field it successfully because of the difficulty of seeing it clearly. During games when a light colored ball is used, it is much more visible and players are able to hit and field it better because they are used to practicing with the two colored practice ball.

5 Claims, 1 Drawing Sheet

PRACTICE BASEBALL/SOFTBALL WITH CONTRASTING COLORS

FIELD OF THE INVENTION

This invention relates generally to game balls and more particularly to a baseball or softball which is specially colored for use in practice activities.

BACKGROUND OF THE INVENTION

Baseball and softball require considerable concentration for good performance during batting and fielding activities. Traditional batting and fielding practice makes use of the same balls that are used in games, although practice balls are often former game balls that have become scuffed or otherwise too worn to be used in games. In any case, practice balls and game balls are for the most part equally visible to batters and fielders.

It is known that when elite professional ball players are playing well, especially during good hitting streaks, the ball appears to them to be particularly large and easy to see. It is thus apparent that the perception that the ball is larger and easier to see is closely associated with good play. If players can use practice techniques that provide them with the ability to see the ball well during games, their level of play can improve significantly. It is also well known that good concentration leads to improved play.

SUMMARY OF THE INVENTION

The present invention is directed to a baseball or softball which is intended for use only in practice and which is specially colored to cause players to increase their concentration during practice activities and to enable the players to see the game balls better during games.

This is accomplished by providing a baseball/softball which has a conventional construction but which has a light color on approximately one half its surface and a relatively dark color on the remainder. As a result of this half light/half dark coloring, the ball is less easily seen than a conventional light colored ball. Consequently, players using the ball during practice tend to concentrate better because the reduced visibility forces them to increase their concentration in order to successfully bat or field. This enhanced concentration during practice improves the skill levels of the players. When normal light colored balls are used during games, they are much easier to see than the practice balls. Thus, the players perceive the game balls to be easy to see and they can bat and field better as a result.

The color pattern on the ball can take a variety of different forms. The cover can be dark on one hemisphere and light on the other. Alternatively, a conventional two-piece cover construction using two pieces sewn together along a seam can be used, with one piece of the cover being entirely dark and the other piece being entirely light. Each piece can also be colored half dark and half light in a different pattern. Patches of light or dark color on a contrasting background can also be used, as can a polka dot pattern or virtually any other color pattern resulting in the surface area of the cover being about one half dark and about one half light.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
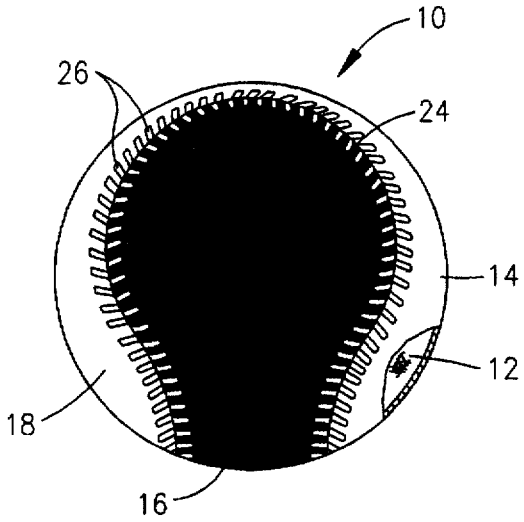
FIG. 1 is an elevational view of a baseball constructed according to a preferred embodiment of the present invention, with a portion of the cover broken away to show the core of the ball.

Referring now to the drawings in detail and initially to FIG. 1, numeral 10 generally designates a baseball which is constructed in accordance with the present invention. The ball 10 has a conventional construction for the most part. A spherical ball member is formed by a core 12 which is enclosed within a cover 14. The core 12 is spherical and may have any suitable construction such as a conventional wound construction.

The cover 14 may likewise have any suitable construction and may be constructed of any suitable material such as cow hide or horse hide. The cover 14 presents a spherical surface when it is applied around the core 12.

It is a particular feature of the present invention that the cover 14 is colored a dark color such as the black color indicated at 16 in FIG. 1 on approximately one half of the surface area of the cover. A light color 18 such as white is visible on the other one half of the surface area.

Figure 2:
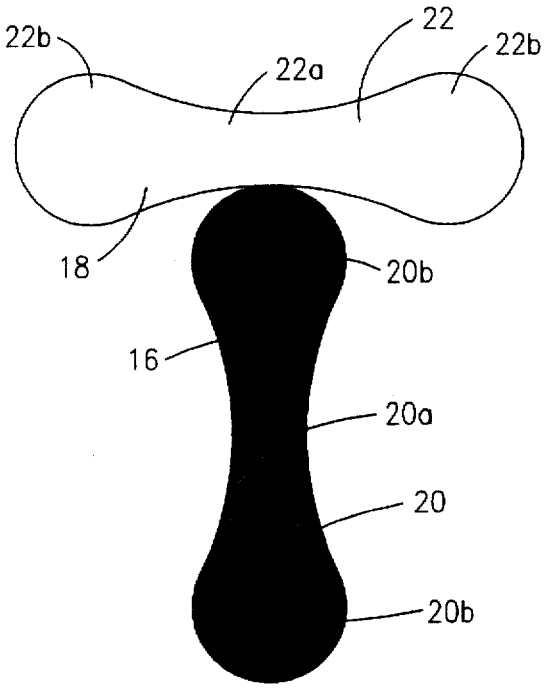
FIG. 2 is a plan view of the two-piece cover for the ball shown in FIG. 1 in the unassembled state.

FIG. 2 depicts one color pattern that may be used for the cover 14. It is standard practice in the construction of covers to utilize a two-piece cover having a pair of sections 20 and 22 of substantially identical shape. Each section 20 and 22 has the general shape of a bone with a relatively thin neck 20*a* or 22*a* connecting to larger rounded ends 20*b* and 22*b*. The sections 20 and 22 are applied to the spherical core 12 by wrapping them around the core with one end 20*b* of section 20 contacting the center of the neck 22*a* of the other section. When the sections 20 and 22 are wrapped around the core 12, the edges of the two sections are adjacent to one another to form a continuous seam 24 (see FIG. 1). The seam 24 is sewn closed and secured by stitching 26 which may be applied in a conventional manner.

As shown in FIGS. 1 and 2, the color pattern for the cover 14 can be obtained by coloring the entire outside surface of section 20 the dark color 16 and coloring the entirety of the outside surface of the other section 22 the light color 18. Because the two sections 20 and 22 are identical in shape and size, the result is that the outside surface of the cover 14 is one half dark and one half light.

Figure 3:
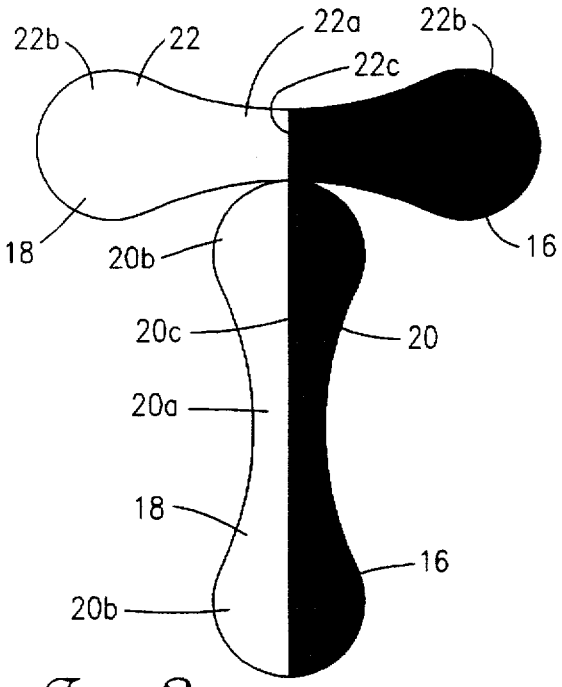
FIG. 3 is a plan view of a modified cover in the unassembled state and constructed according to a modified embodiment of the invention.

FIG. 3 depicts an alternative color pattern for the two sections 20 and 22 of the cover 14. In this arrangement, the two sections are wrapped around and secured to the core 12 in the same manner previously described. However, the color pattern is modified from the previous embodiment. Section 20 has a longitudinal axis 20*c* extending the entire length of the section. The section 20 is symmetrical about the longitudinal axis 20*c*. On one side of the axis 20*c*, section 20 is colored the dark color 16, and it is colored the light color 18 on the other or opposite side of the axis 20*c*. The other section 22 has a transverse axis 22*c* extending across the neck 22*a* and about which section 22 is symmetrical. Section 22 is colored the dark color 16 on one side of the axis 22*c* and the light color on the other side of the axis 22c. When the two sections 20 and 22 shown in FIG. 3 are wrapped around the core 12 and stitched to one another, the color pattern that results is that one hemisphere of the cover 14 is the dark color 16 on one side of a circumferential line coincident with the axes 20c and 22c, and the other hemisphere on the other side of the circumferential line is the light color 18. Again, half the surface area of the cover 14 is the dark color and half is the light color.

Figure 4:
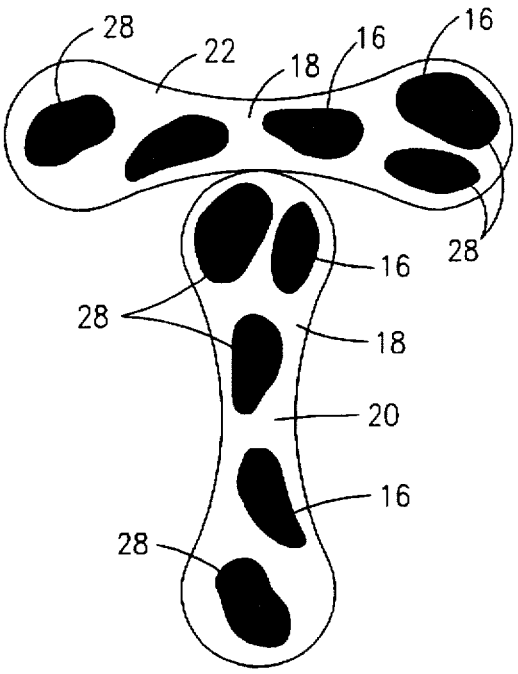
FIG. 4 is a plan view of still another two-piece cover in the unassembled state and constructed according to a further modified embodiment of the invention.

FIG. 4 depicts yet another color pattern for the two sections 20 and 22. In this arrangement, each section is provided with a plurality of irregular patches 28 which are colored the dark color 16. The background of each section is the contrasting light color 18. On each section 20 and 22 shown in FIG. 4, the patches 28 occupy approximately one half of the surface area of the section, while the background light color 16 occupies the remaining one half of the surface area. When the sections are wrapped around the core 12 and stitched to one another, the dark patches 28 are distributed throughout the surface area of the cover and occupy approximately one half of its surface.

In use, the ball 10 is intended to be only a practice ball used in practice activities and not in games. Because the visible portion of the ball is one half dark and one half light, it is much more difficult to see than a conventional ball which is substantially all light. Accordingly, during practice activities, it is necessary for users to concentrate more intensely than normal in order to successfully bat or field the ball 10. The need for enhanced concentration makes practice sessions more effective and efficient and improves the skill level of the players.

During games, a conventional light colored ball is used. If the participants have been practicing with the two-colored ball 10, the conventional light colored ball used in the game is much easier to see and thus much easier to bat and field. Consequently, the players perceive the game ball to be large and easy to see, and their success in batting and fielding is increased accordingly.

Although the invention has been described in connection with the baseball 10, it should be noted that the color pattern it exhibits can be used for a softball as well. The same benefits are obtained when the ball is used as a practice softball. It is also to be noted that while several different color patterns have been specifically disclosed, other patterns such as dark polka dots on a light background or light polka dots on a dark background are possible, so long as the dark and light colors each occupy approximately one half of the surface area of the ball. While it is preferred for the dark color 12 to be black and the light color 18 to be white, other dark and light colors are possible so long as there is sufficient contrast between the two colors to make the ball more difficult to see than a conventional light colored ball.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, I claim:

1. A practice baseball/softball comprising:

a substantially spherical ball member having a substantially spherical surface; and means on said surface for providing a relatively light color on approximately one half the area thereof and a relatively dark color on approximately one half the area thereof, wherein said ball member has a core and a cover surrounding said core;

said cover includes first and second sections stitched together along a seam, each section occupying substantially one half of the area of said surface;

each said section has a longitudinal axis and a transverse axis and is symmetrical about each said axis;

said first section is colored said light color on one side of the longitudinal axis thereof and said dark color on the other side of the longitudinal axis thereof; and said second section is colored said light color on one side of the transverse axis thereof and said dark color on the other side of the transverse axis thereof.

2. A baseball/softball as set forth in claim 1, wherein said dark color is black and said light color is white.

3. A practice baseball/softball for use in practicing batting and fielding, said baseball/softball comprising:

a ball member having a substantially spherical outer surface, approximately one half of the area of said surface being a relatively light color and approximately one half of the area of said surface being a relatively dark color, wherein said ball member has a core and a cover surrounding said core;

said cover includes first and second sections stitched together along a seam, each section occupying substantially one half of the area of said surface;

each said section has a longitudinal axis and a transverse axis and is symmetrical about each said axis;

said first section is colored said light color on one side of the longitudinal axis thereof and said dark color on the other side of the longitudinal axis thereof; and said second section is colored said light color on one side of the transverse axis thereof and said dark color on the other side of the transverse axis thereof.

4. A baseball/softball as set forth in claim 3, wherein said dark color is black and said light color is white.

5. A practice baseball/softball for use in practicing batting and fielding, comprising:

a ball member having a substantially spherical outer surface which is colored white on approximately one half its area and colored black on approximately one half its area, wherein said ball member has a core and a cover surrounding said core;

said cover includes first and second sections stitched together along a seam, each section occupying substantially one half of the area of said surface;

each said section has a longitudinal axis and a transverse axis and is symmetrical about each said axis;

said first section is colored white on one side of the longitudinal axis thereof and black on the other side of the longitudinal axis thereof; and said second section is colored white on one side of the transverse axis thereof and black on the other side of the transverse axis thereof.

* * * * *